US008042482B2

(12) United States Patent
Davis

(10) Patent No.: US 8,042,482 B2
(45) Date of Patent: Oct. 25, 2011

(54) STEERING DEVICE FOR A TOWED PERSONAL WATERCRAFT

(76) Inventor: Rick Davis, Battle Creek, MI (US)

( * ) Notice: Subject to any disclaimer, the term of this patent is extended or adjusted under 35 U.S.C. 154(b) by 253 days.

(21) Appl. No.: 12/455,768

(22) Filed: Jun. 5, 2009

(65) Prior Publication Data

US 2009/0301374 A1 Dec. 10, 2009

Related U.S. Application Data

(60) Provisional application No. 61/131,159, filed on Jun. 7, 2008.

(51) Int. Cl.
*B63B 1/30* (2006.01)

(52) U.S. Cl. ..... 114/282

(58) Field of Classification Search ..... 114/144 R, 114/271, 281, 282, 162; 441/65, 79
See application file for complete search history.

(56) References Cited

U.S. PATENT DOCUMENTS

| | | | | |
|---|---|---|---|---|
| 3,581,328 | A * | 6/1971 | Smith | 441/67 |
| 5,899,782 | A * | 5/1999 | Martin | 441/66 |
| 6,182,594 | B1 * | 2/2001 | Wilson | 114/253 |
| 6,247,984 | B1 * | 6/2001 | Hatcher | 441/66 |
| 6,655,701 | B2 * | 12/2003 | Oberpriller | 280/21.1 |
| 7,216,600 | B1 * | 5/2007 | Hamilton et al. | 114/242 |

* cited by examiner

*Primary Examiner* — Daniel Venne
(74) *Attorney, Agent, or Firm* — Robert M. Downey, P.A.

(57) ABSTRACT

A steering device includes a main body that attaches to a tow rope, inline between a towing vessel and a personal watercraft. The main body, which is positioned just forward of the personal watercraft, accommodates an extendable rudder that moves between a normally retracted position within the main body, and a lowered, operable position to exert a steering force on the main body and the personal watercraft. An elongate tiller extends between the rudder and a handle that is optimally positioned for grasping by the rider of the personal watercraft. In accordance with several embodiments, movement of the rudder from the relaxed, retracted position to the lowered, operable position is achieved by exerting a particular directional force on the handle (e.g., pulling, pushing forward, or lifting). Moving the handle to the left or the right achieves the desired steering action. Upon release of the handle by the rider, the rudder returns to the normally retracted position, thereby removing the steering influence.

9 Claims, 3 Drawing Sheets

STEERING DEVICE FOR A TOWED PERSONAL WATERCRAFT

This application claims the benefit of U.S. Provisional Patent Application Ser. No. 61/131,159 filed on Jun. 7, 2008.

BACKGROUND OF THE INVENTION

1. Field of the Invention

The present invention relates to steering mechanisms for personal watercraft and, more particularly, to a steering device that attaches between a towing vessel and a towed personal watercraft, and wherein the steering device includes a deployable rudder for steering the personal watercraft.

2. Discussion of the Related Art

Towing a personal watercraft, carrying one or more riders, behind a motor powered vessel is a popular recreational boating activity. Examples of towable personal watercraft include inflated crafts such as tubes, as well as surfboards, kneeboards and other buoyant unpowered structures. The personal watercraft is pulled by a tow rope, often referred to as a ski rope, that attaches at one end at or near the stern of the towing vessel. For activities such as water skiing, kneeboarding and wakeboarding, the opposite end of the ski rope is normally held by the skier/rider, and steering can be accomplished by leaning and turning into the desired direction of movement. Other activities, such as towing an inflated tube (often referred to as "tubing"), require the opposite end of the tow rope be attached to the forward end of the towed personal watercraft. In this instance, the rider(s) has very little control over the directional movement of the towed personal watercraft and is essentially at the mercy of the steering direction of the towing vessel. Specifically, as the towing vessel turns in one direction (i.e., left or right) the towed personal watercraft will swing naturally outwards away from the turning direction of the towing vessel. This outward whipping action results in a sudden acceleration of the personal watercraft across the surface of the water that often causes the towed watercraft to flip over in a rather violent action. Moreover, outward movement of the watercraft, beyond the wake of the towing vessel, can expose the towed personal watercraft to hazards, such as fixed structures (e.g., docks, pilings, anchored boats, bridge structures and shoreline obstacles) as well as boats that are underway and possibly moving at high speeds. Accordingly, the inability to steer the towed personal watercraft exposes the rider(s) to potential serious injury or death. On the other hand, providing the rider of the towed personal watercraft with the ability to steer the watercraft allows for a safer and more enjoyable experience.

Considering the foregoing, there remains an urgent need for a simple, relatively inexpensive and easy to operate steering device for use with towed personal watercraft to allow the rider of the personal watercraft to steer in a desired direction and out harms way.

SUMMARY OF THE INVENTION

The present invention is directed to a steering device for a towed personal watercraft. The steering device includes a buoyant main body with a forward end, a central portion and a rear end. An eyelet or fitting on the forward end attaches to a tow rope extending from a motor powered towing vessel. A linkage on the rear end of the main body attaches to the front of the personal watercraft, allowing the buoyant main body to ride along the surface of the water, just forward of the personal watercraft, when being towed by the motor powered vessel. Alternatively, the steering device can be built into the forward end of the personal watercraft as an integral unit.

A fore and aft vertical rudder chamber accommodates a retractable rudder. The rudder is connected to an elongate tiller that extends upwardly and rearwardly of the main body to a steering handle. The steering handle is optimally positioned for gripping by a person riding in or on the personal watercraft.

In a relaxed state, the rudder remains retracted within the rudder chamber, providing no steering influence on the main body or personal watercraft. Application of a particular directional force on the handle (e.g., pulling back, pushing forward, or lifting) in accordance with various embodiments of the invention, urges the rudder downwardly and out from the bottom of the main body, into the flow of water to thereby provide a controllable steering mechanism. The rider can steer the personal watercraft by moving the handle to the left or right. Specifically, moving the handle to the left causes angular movement of the rudder to thereby steer the personal watercraft to the right. Similarly, movement of the handle to the right steers the personal watercraft in the left direction. Upon releasing the handle, the rudder is urged back to the retracted position, where it is concealed within the rudder chamber, thereby removing all steering influence. The steering device allows a rider of the personal watercraft to steer away from danger. Moreover, the steering device allows towing of a personal watercraft at slower speeds, while still providing for adequate steering control to the left and right of the towing vessel's wake, thereby reducing fuel consumption while still providing a safe and enjoyable activity.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
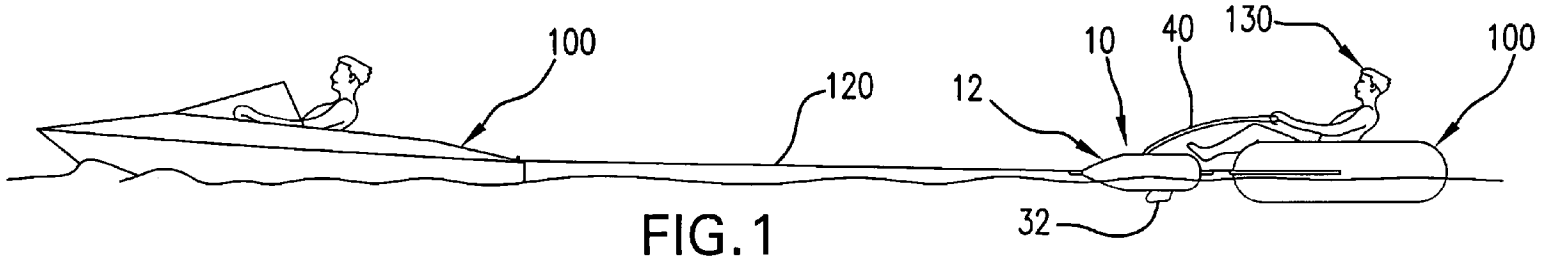
FIG. 1 is a side elevational view showing a motor boat towing a rider in an inflatable tube with the steering device of the present invention connected just forwardly of the inflated tube.

Referring to the several views of the drawings, a steering device for a towed personal watercraft is shown in accordance with several preferred embodiments. In each of the drawing figures, the steering device is generally indicated as 10.

The steering device (10) of the several embodiments shown throughout the drawing figures includes a main body (12) including a forward end (14), a central portion (16) and rear end (18). As seen in FIG. 1, the steering device (10) connects inline between a motor powered towing vessel (110), such as a motor boat, and a personal watercraft (100). More particularly, the steering device (10) is linked to the front end (102) of the personal watercraft (100), so that a rider can control operation of the steering device (10), as described more fully hereinafter. Alternatively, the device could be built into the forward end of the personal watercraft (100) during manufacture of the personal watercraft.

The forward end (14) of the main body (12) of the steering device is provided with an eyelet (15) or other fitting for attaching a tow rope (120) extending from the stern of the towing vessel (110). The rear end (18) of the main body (12) includes and eyelet (17) or other linkage mechanism for connecting to the front end (102) of the personal watercraft (100). The linking connection may include a short segment (19) of rope, a rubber segment, or suitable linking mechanism. The main body (12) is buoyant so that it floats on the surface of the water, allowing the main body to ride along the surface of the water when the device (10) and personal watercraft (100) are towed. To provide sufficient buoyancy, the main body (12) may include a foam filled interior core. Alternatively, the interior core of the main body can be hollow.

In each of the embodiments, as shown throughout the drawings, the central portion (16) of the main body is provided with a fore and aft vertical slot (20) extending through the entire height of the main body, from a topside, to a bottomside. The vertical slot (20) defines a rudder chamber (22) for accommodating a retracting steering rudder assembly (30). FIGS. 2-6 show various embodiments of the retracting rudder assembly (30) that allows the steering rudder (32) to move between a retracted, stowed position, wherein the rudder (32) is concealed within the rudder chamber (22), and an extended, operable position, wherein the rudder (32) is positioned within the stream of water flow below the main body (12) as the device (10) and personal watercraft (100) are towed along the surface of the water. In each of the embodiments, an elongate tiller (40) extends from the rudder assembly (30) and rearwardly to a handle (50) on the end of the tiller (40). The handle (50) is optimally positioned relative to a rider (130) in the personal watercraft (100) so that the rider (130) can grasp and manipulate the tiller (40), thereby effectively controlling operation of the rudder (32).

Figure 2:
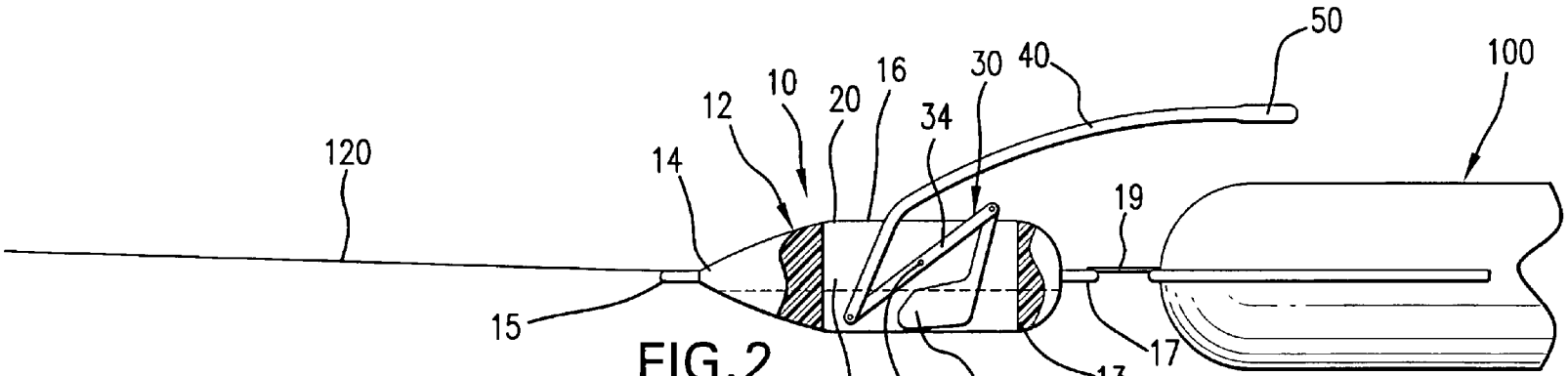
FIG. 2 is an isolated side elevational view, in partial cross-section, showing one preferred embodiment of the steering device of the present invention connected to the forward end of an inflated towable watercraft.
Figure 3:
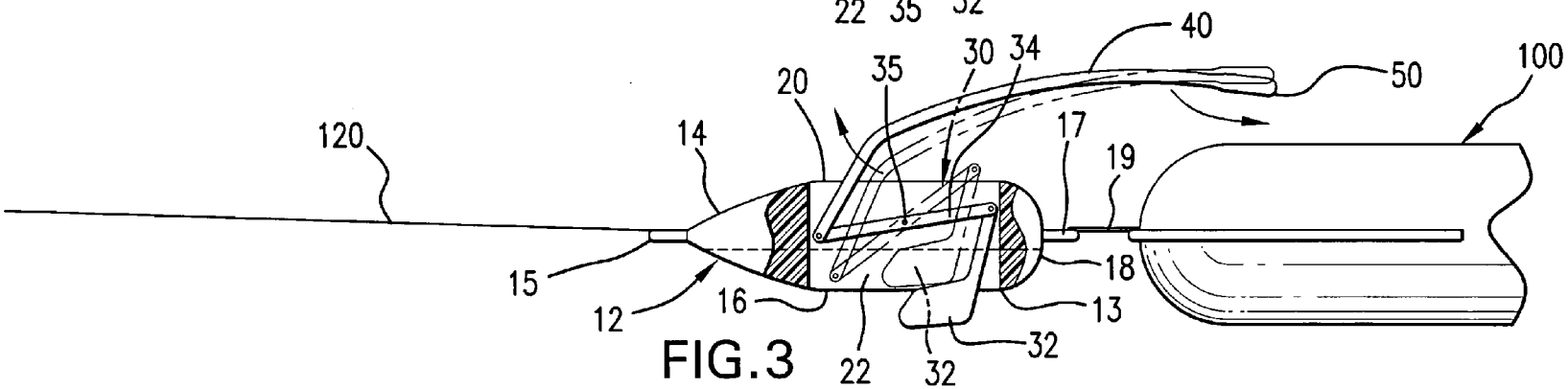
FIG. 3 is an isolated side elevation, in partial cross-section, showing the embodiment of FIG. 2 with the rudder being moved from a normally retracted position, to a lowered, operable position, by applying a pulling force on a handle of the device.

FIGS. 2 and 3 illustrate one preferred embodiment of the retracting rudder assembly (30). Specifically, a pivoting arm member (34) is pivotally connected between a vertical extension (36) of the rudder (32) and a lower distal end (42) of the tiller (40). The arm member (34) pivots about a central pivot point (35) within the rudder chamber (22). FIG. 2 shows the rudder (32) in a normally relaxed, stowed position, wherein the rudder (32) is concealed within the rudder chamber (22). In this position, the rudder has no steering effect. Upon applying a pulling force on the handle (50), in a direction toward the rider (130) (see FIGS. 1 and 3), the tiller (40) pulls the linking arm member (34) upwardly, causing the arm (34) to pivot about the central pivot point (35), and thereby driving the rudder (32) downwardly below the bottom of the main body (12) and into the water below the main body, as seen in FIG. 3. In this position, shown in FIG. 3, the rudder (32) is able to exert a steering force, as the rudder (32) can be angularly positioned relative to the flow water below the main body (12) of the steering device. Upon release of the handle (50) by the rider (130), the weight of the tiller (40) acting on the linking arm member (34) causes the linking arm member (34) to pivot about the central pivot point (35). Specifically, the weight of the tiller (40) forces the end of the linking arm member (34) connected to the tiller, downwardly, as the opposite end that is linked to the rudder (32) rises up to retract the rudder (32) into the rudder chamber (22).

Figure 4:
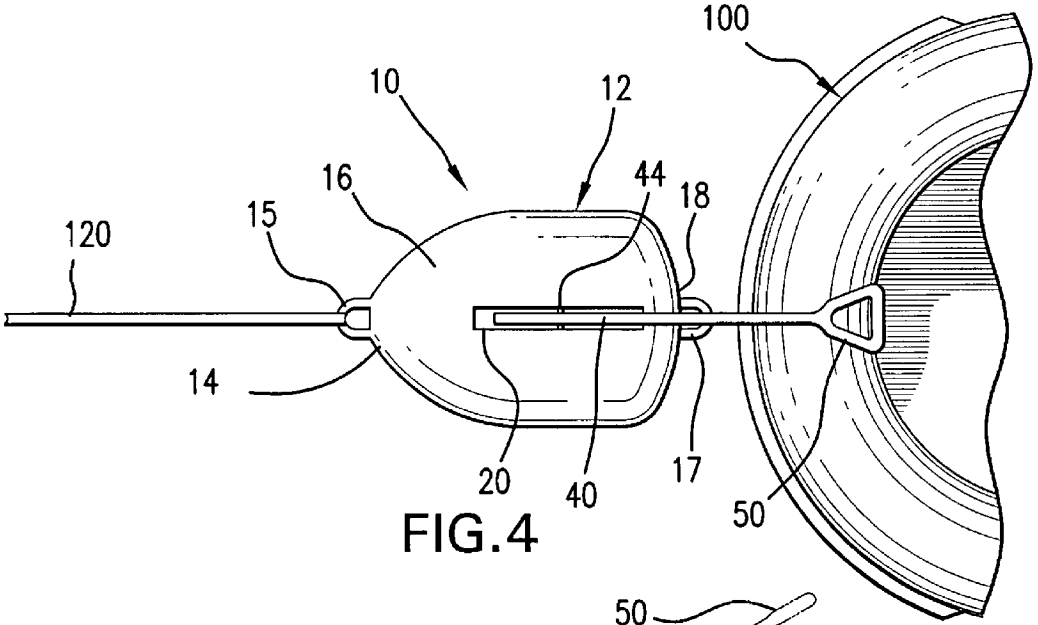
FIG. 4 is an isolated top plan view showing the steering of the present invention in relation to the forward end of an inflated towable personal watercraft.
Figure 5:
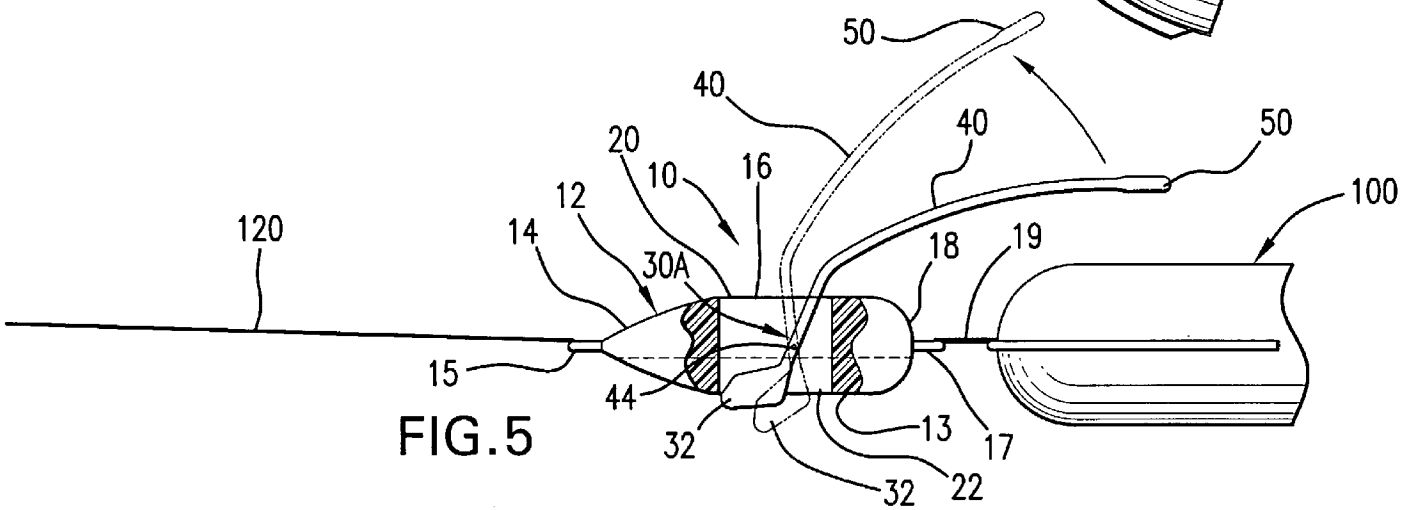
FIG. 5 is an isolated side elevation, in partial cross-section, showing a second preferred embodiment of the steering device of the present invention and illustrating operable movement of the rudder from a normally retracted, concealed position to a lowered, operable position by applying a lifting force to the handle of the device.

FIGS. 4 and 5 illustrate a second preferred embodiment of the rudder retracting assembly (30A). In this particular embodiment, the rudder (32), tiller (40) and handle (50) are structured as single unit. The lower end of the tiller (40), just above the rudder (32) is pivotally fitted within the rudder chamber (22), on a horizontal pivot axle (44). Accordingly, the rudder (32) and tiller (40) are pivotally moveable about the horizontal axle (44) upon exerting an upward, lifting force on the handle (50), as demonstrated by the arrow in FIG. 5. This upward lifting movement of the handle (50) causes the rudder (32) to move downwardly, out from the rudder chamber (22) and below the bottom surface (13) of the main body (12) of the steering device (10), into the flow of water below the device.

Figure 6:
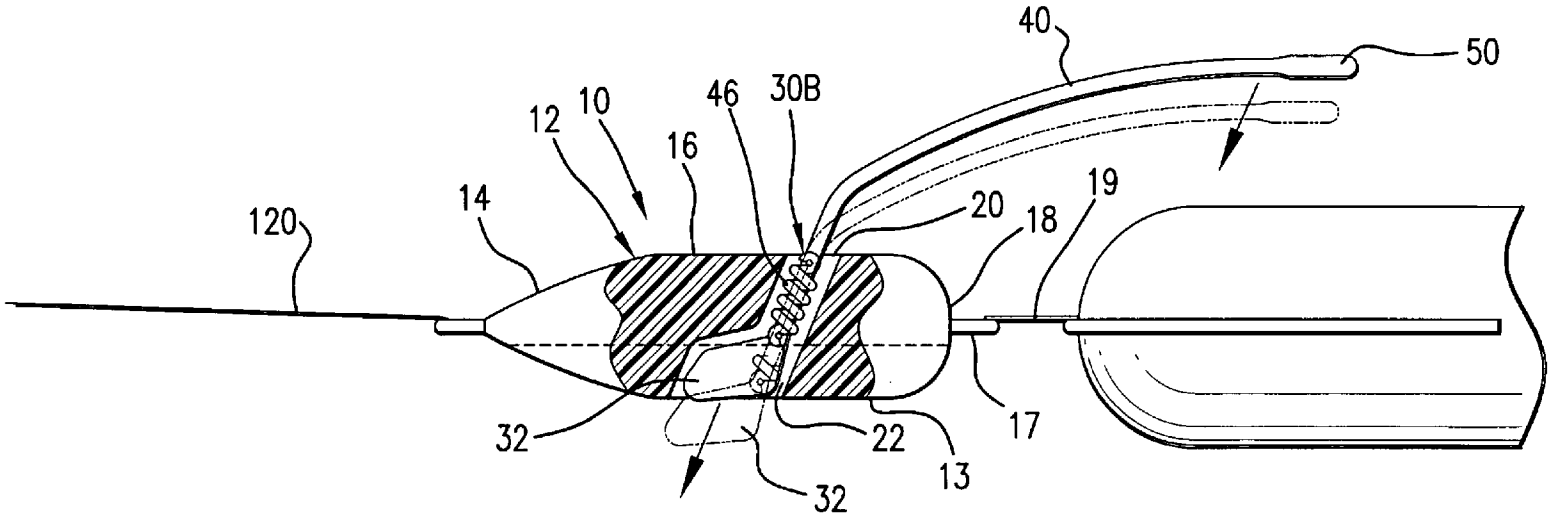
FIG. 6 is an isolated side elevational view, in partial cross-section, showing a third preferred embodiment of the present invention and illustrating movement of the rudder from the retracted, concealed position, to the lowered, operable position by applying a forward and downward force on the handle of the device.

FIG. 6 illustrates a third preferred embodiment of the rudder retracting assembly (30B). Similar to the embodiment of FIGS. 4 and 5, the rudder (32), tiller (40) and handle (50) are formed as a single unit. In this particular embodiment, the rudder (32) is normally urged to the retracted, concealed position by a spring (46) connecting between the lower distal end portion of the tiller (40) and main body (12), within the rudder chamber (22). Forward and downward movement of the handle (50) urges the rudder (32) downwardly, as shown by the arrow in FIG. 6, to the extended, operable position, wherein the rudder (32) is disposed below the bottom surface (13) of the main body (12) and into the stream water flow below the main body of the device (10). In this extended position, the rudder (32) is able to exert a steering force. Upon release of the handle (50), the spring (46) urges the rudder (32) back to the retracted, stowed position, wherein the rudder (32) is concealed entirely within the rudder chamber (22). In this position, the rudder (32) has no steering influence.

Figure 7:
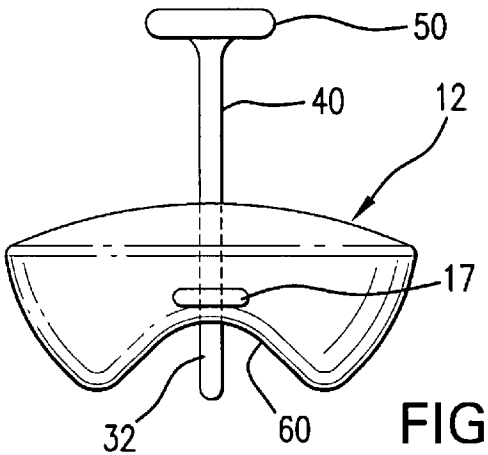
FIG. 7 is a rear elevational view of the steering device, showing the bottom contour of the main body, in accordance with one embodiment thereof.

FIG. 7 shows a rear elevational view of the main body (12) of the device, wherein the bottom of the main body (12) is shown to include a concave centerline channel (60). This bottom configuration of the main body (12) provides stability to the main body while riding along the surface of the water, while also enhancing the steering effect of the rudder (32) when employed to the extended, operable position.

While the present invention has been shown and described in accordance with preferred and practical embodiments thereof, it is recognized that departures from the instant disclosure are fully contemplated within the spirit and scope of the invention.

What is claimed is:

1. A steering device for use with a personal watercraft that is towed behind a powered vessel with the use of a tow rope attached to and extending from the powered vessel, said steering device comprising:

a main body operatively positionable inline with the tow rope extending between the powered vessel and the personal watercraft, and said main body including a top side, a bottom side and a rudder chamber between the top and bottom sides;

an extendable rudder concealed within said rudder chamber in a retracted position and said rudder being operably moveable from said retracted position to a lowered, operable position defined by at least a portion of said rudder extending below said bottom side of said main body for exerting a steering force on said main body and said personal watercraft when said personal watercraft is moving along a surface of a body of water;

an elongate tiller connected to said rudder and extending to an end portion that is positioned for grasping by a rider of the personal watercraft, and said rudder being moved from said retracted position to said lowered, operable position upon application of an external force on said end portion of said tiller.

2. The steering device as recited in claim 1 wherein said end portion of said tiller includes a handle for grasping by the rider of the personal watercraft.

3. The steering device as recited in claim 1 wherein said rudder chamber is fined by a fore and aft vertical slot extending from the top side of said main body to the bottom side of said main body, and said slot being open at the top side and the bottom side of said main body.

4. The steering device as recited in claim 1 wherein said main body is attached inline between the tow rope and the personal watercraft.

5. The steering device as recited in claim 1 wherein said tiller is pivotally attached to said main body within said rudder chamber.

6. The steering device as recited in claim 5 wherein said tiller is pivotally linked to said rudder.

7. The steering device as recited in claim 1 wherein said tiller is pivotally linked to said rudder by a pivoting arm member that is pivotally connected at opposite ends to said rudder and said tiller, and said pivoting arm member being further pivotally connected to said main body within said rudder chamber.

8. The steering device as recited in claim 1 further comprising:

a spring element within said rudder chamber for moving said rudder to said retracted position upon removal of the external force.

9. The steering device as recited in claim 1 wherein said main body is buoyant.

* * * * *